US005694869A

United States Patent [19]

Breen et al.

[11] Patent Number: 5,694,869

[45] Date of Patent: Dec. 9, 1997

[54] REDUCING NOX EMISSIONS FROM A ROOF-FIRED FURNACE USING SEPARATED PARALLEL FLOW OVERFIRE AIR

[75] Inventors: Bernard P. Breen, Pittsburgh; John P. Bionda, Jr., Coraopolis, both of Pa.; James E. Gabrielson, Plymouth, Minn.; Anthony Hallo, Springdale; John M. Koltick, Jr., Bethel Park, both of Pa.

[73] Assignee: Duquesne Light Company and Energy Systems Associates, Pittsburgh, Pa.

[21] Appl. No.: 365,853

[22] Filed: Dec. 29, 1994

[51] Int. Cl.[6] ..... F23J 11/00

[52] U.S. Cl. ..... 110/345; 110/214

[58] Field of Search ..... 110/345, 347, 110/348, 210–212, 214, 261, 265, 234

[56] References Cited

U.S. PATENT DOCUMENTS

| | | | |
|---|---|---|---|
| 2,573,910 | 11/1951 | Kreisinger | 110/348 X |
| 2,617,405 | 11/1952 | Keller | 110/261 X |
| 4,316,420 | 2/1982 | Kochey | 110/347 |
| 4,626,204 | 12/1986 | Saint Julian et al. | 110/265 X |
| 4,629,413 | 12/1986 | Michelson et al. | 431/9 |
| 5,020,454 | 6/1991 | Hellewell et al. | 110/264 |
| 5,158,024 | 10/1992 | Tanaka et al. | 110/347 X |
| 5,299,929 | 4/1994 | Yap | 431/8 |

OTHER PUBLICATIONS

Zeldovich, Ya.; Acta Phsiochin; 21; 577; translated version, 1946.

*Primary Examiner*—Henry A. Bennett
*Assistant Examiner*—Susanne C. Tinker
*Attorney, Agent, or Firm*—Dickie, McCamey & Chilcote, P.C.; Leland P. Schermer; John N. Cox

[57] ABSTRACT

An improved method and apparatus for supplying combustion air in a roof-fired furnace. Part of the combustion air, overfire air, enters through the roof of a roof-fired furnace at positions separate from the coal burners. The separated entry of overfire air ensures that the initial stages of combustion occur in a fuel-rich environment. A fuel-rich environment during the early stages of combustion favors the formation of molecular nitrogen and disfavors the formation of nitrogen oxides during combustion. The overfire air flows roughly parallel to the flow of combustion products emanating from the coal burners. The overfire air can be angled by vanes either slightly towards or slightly away from the combustion products, depending on how long combustion needs to be retarded in order to inhibit the formation of nitrogen oxides.

29 Claims, 4 Drawing Sheets

REDUCING NOX EMISSIONS FROM A ROOF-FIRED FURNACE USING SEPARATED PARALLEL FLOW OVERFIRE AIR

BACKGROUND OF THE INVENTION

1. Field of the Invention

This invention relates to control of nitrogen oxides emitted from combustion devices. The invention will be most useful on furnaces, boilers, steam generators, and heaters which function in some respects in a manner similar to furnaces. The invention consists of an apparatus and method for reducing the formation of nitrogen oxides in roof-fired furnaces by the staged addition of combustion air.

2. Description of the Prior Art

Nitrogen oxides ("NOX") emitted from combustion devices are a major regulatory concern in many industrialized countries. Nitrogen oxide ("NO"), which is the usual form of NOX emitted from furnaces, is converted to nitrogen dioxide ("NO2") in the atmosphere in a matter of a few hours or days after emission. NOX emissions are currently the subject of strict regulatory control. Among the objectives of these regulations are: reduction of acid rain, reduction of smog, reduction of eye and respiratory irritation, and reduction of formation of ozone. Some laws and regulations governing NOX emissions have been in force for 25 years. Additionally, even more stringent regulatory control will become effective after 1995.

Empirical studies have identified two mechanisms for the formation of NOX in pulverized coal-air flames: (1) thermal reaction of nitrogen and oxygen contained with combustion air to form NOX ("thermal NOX"), and (2) the oxidation of organically bound nitrogen compounds contained within coal to NOX ("fuel NOX"). For conventional furnaces, thermal NOX formation becomes significant at temperatures above 2800° F. Conversion of fuel-bound nitrogen to NOX can occur at much lower temperatures. Empirical studies have revealed that fuel NOX represents a substantial portion of the total NOX formed in a pulverized coal flame.

The reactions involved in the formation of thermal NOX are generally regarded to be:

(1) O2=O+O (2) O+N2=NO+N (3) N+O2=NO+O (4) N+N=N2

Reaction 1 is an equilibrium reaction and the atomic oxygen formed in this reaction is in equilibrium with the molecular oxygen ("O2"). The relative equilibrium concentrations of Reaction 1 is very temperature dependent and the amount of atomic oxygen is very small below 2800° F. Also, the total amount of atomic oxygen is dependent upon the concentration of molecular oxygen in the combustion zone.

Atomic oxygen formed in Reaction 1 can react with molecular nitrogen to form NO and N, as shown in Reaction 2. Atomic nitrogen, which is formed in Reaction 2, is converted at an efficiency of 5 to 50 percent to NO, as shown in Reaction 3, depending upon the availability of molecular oxygen in the combustion zone. If the concentration of molecular oxygen is low, then the dominant reaction for atomic nitrogen will be Reaction 4 that results in molecular nitrogen ("N2"). N2 is the desired reaction product. These reactions have been studied, described, and quantified by Zeldovich. Zeldovich, Ya. B." Acta Physicohin, USSR, 21,577. Therefore, to avoid thermal NOX formation, it is important to control the amount of coal that is burned in the combustion zone at temperatures above 2800° F. and to minimize the amount of excess oxygen in the combustion zone.

Fuel NOX is formed when fuel-bound nitrogen reacts with atmospheric oxygen. Fuel-bound nitrogen becomes atomic nitrogen (or part of a very reactive radical) when oxygen consumes the hydrocarbon molecule in which the fuel-bound nitrogen was originally located. Once atomic nitrogen becomes available in the combustion zone, it can react with molecular oxygen (Reaction 3) or it can react with another atomic nitrogen (Reaction 4). Reaction 3 is favored and NO is formed at efficiencies up to 50 percent, if there is excess air (which results in excess oxygen) present in the combustion zone. However, if there is little or no excess oxygen when the atomic nitrogen is liberated from the fuel, then Reaction 4 is favored and N2 is formed at efficiencies up to 90 percent.

Fuel-bound nitrogen contained in the volatile fraction of coal will be burned quickly because the volatile fraction of coal is evolved and burned within the first 200 milliseconds of combustion. This first 200 milliseconds represents the period in which atomic nitrogen from fuel-bound nitrogen in the volatile fraction is available for reaction. Therefore, to avoid fuel NOX formation, it is important to minimize or eliminate the amount of excess oxygen in the combustion zone where atomic nitrogen is formed.

NOX emissions from furnaces have been the subject of regulatory scrutiny for many years. Many successful devices and procedures have been used to reduce NOX emissions from furnaces. Fuels such as natural gas have no fuel-bound nitrogen and NOX emissions can be reduced by lowering flame temperatures. Reduced air preheat, flue gas recirculation and water injection have been used in various types of furnaces to reduce NOX emissions from natural gas combustion. However, these techniques are not effective in reducing the formation of fuel NOX. Oil fuel, which has some fuel-bound nitrogen, has sometimes been treated with the techniques used in natural gas combustion, but they are only partially effective.

The content of nitrogen by weight of coals typically burned by utilities can vary from 0.3% to over 2.0%. A coal having 1% nitrogen by weight and a heating value of 12,000 Btu per pound would emit the equivalent of 0.5 pounds of NOX per million Btu's, if only 20% of the fuel-bound nitrogen was converted to NOX. Any thermal NOX would add to this amount. Therefore, to meet expected emission limits and current limits for some furnaces (0.5 pounds of NOX per million Btu's of heat input) it is necessary that no more than 20 percent conversion of the fuel-bound nitrogen be converted into NOX. Numerous techniques have been tried to achieve these goals.

Slowly mixing or controlled mixing burners have been used on face fired and tangential fired furnaces to reduce NOX emissions. While some success has been achieved with this method, they are expensive and may result in increased carbon in the fly ash. Increased fly ash carbon can disrupt the functioning of the particulate removal devices and may cause destructive and dangerous fires in the back end of the combustion device. Controlled mixing burners have also been tried on roof-fired furnaces, but their application has been limited.

Many roof-fired furnaces have uniquely designed fuel delivery and burner systems. In these systems, coal is pulverized or milled so most of the coal will pass through a 70 mesh screen. The milled coal is then blown into the furnace by 10 to 25 percent of the combustion air. The coal and air from the pulverizer is divided into several pipes, each pipe supplying a burner which is typically 12 to 48 inches in diameter. This coal pulverization and delivery system is typical of many furnaces, but in some roof-fired furnaces the coal burner is further divided into 4 to 16 nozzles before the air and coal is discharged into the furnace. The burners are located in the roof of the furnace and the fuel is fired vertically downward. Different furnaces will have different numbers of pulverizers, burners, and nozzles per burner. These nozzles are only about 1 to 3 inches in diameter. The secondary air also is supplied through openings which usually are not more than 4 inches wide. Typically, there are multiple secondary air openings for each nozzle. The small size of these nozzles and secondary air openings allows the coal, primary air, and secondary air to be discharged into the furnace through spaces between boiler tubes in the roof of the furnace. This type configuration is known as a multi-nozzle, inter-tube burner.

To retrofit roof-fired furnaces which currently employ the multi-nozzle, inter-tube burner with low NOX burners requires substantial modification to the furnace roof. The furnace top for roof-fired furnaces is usually defined by boiler tubes between which there are spaces. The nozzles and the secondary air pass through these spaces. These tubes must be cut out and replaced with bent sections to allow new low NOX burners to be installed. This can be an expensive retrofit.

Another type of retrofit is the addition of NOX ports or overfire air ports. Typically, low NOX burners are installed in combination with overfire air ports. With overfire air ports, some combustion air is diverted from the burners and supplied to the overfire air ports. This results in the early stages of combustion (about 0.2 to 0.5 seconds) occurring in a fuel-rich environment. Because fuel-bound nitrogen contained within the volatile portion of coal is generally evolved during the first 200 milliseconds of combustion, the overfire air enters the combustion process after this fuel-bound nitrogen has been liberated. Because this fuel-bound nitrogen is liberated in a fuel-rich environment, it will preferentially react with atomic nitrogen to form N2 and will not react with molecular oxygen in significant amounts to form NOX. Further, because of the delayed addition of combustion air from the overfire air ports, the average combustion temperature has been reduced by heat transfer to the boiler tubes. This lowering of the combustion temperature will reduce thermal NOX formation.

However, the system just described has numerous drawbacks when applied to a roof-fired unit that uses nozzles to discharge coal into the furnace. Installation of the low NOX burners and overfire air ports requires modification and replacement of many boiler tubes in the furnace roof. The wind box must be converted to accommodate new and expensive low NOX burners. Duct work must be installed to bring overfire air from existing duct work or the windbox to the overfire air ports. Refractory throats must be constructed for both the burners and the overfire air ports. Dampers must be installed for the overfire air ports. Typically, when overfire air ports are installed, there is no easy method of adjusting the distribution of combustion air to assure substantially complete combustion while achieving the required level of NOX reduction.

As shown above, economical methods of retrofitting low NOX systems to roof-fired furnaces using multi-nozzle, inter-tube burners are not generally available. Such systems as are available have experienced only limited testing with natural gas, fuel oil, and pulverized coal.

Various back end or post combustion treatments to reduce NOX after it has been formed during combustion are available and are used in certain situations. One process is referred to as thermal deNOX, non-catalytic deNOX, or selective non-catalytic NOX reduction ("SNCR"). Another process is referred to as selective catalytic NOX reduction ("SCR"). Both of these require ammonia ("NH3"), a toxic and difficult to handle gas or pressurized liquid. SNCR requires very careful injection of vaporized and diluted ammonia at a very narrow temperature window which may move in the furnace as load or other conditions change. SCR require a very expensive catalyst. These systems are so expensive as to be practical only where the most stringent laws are in force and after the less-expensive measures to reduce NOX formation during combustion have been taken. Further, these deNOX processes are usually applied to furnaces which only fire natural gas or oil.

Reburn, or in-furnace NOX reduction, is a technique where a fuel, usually natural gas or other high grade and expensive fuel which contains little or no fuel-bound nitrogen, is introduced in the furnace well downstream of the burners. The fuel is introduced in sufficient quantities to cause the gas stream to be fuel-rich. Temperatures of about 2000° F. to 2400° F. are desirable for this process but they are not always available before the gases flow through the convective passes of the furnace. The NO in the gas stream reacts with the fuel to form carbon dioxide, water vapor, molecular nitrogen, and fixed nitrogen compounds, such as, ammonia, hydrogen cyanide, and amines. Then enough additional air is provided to complete the combustion substantially and to make the gas fuel lean, preferably at the lower end of the temperature range. The fixed nitrogen compounds are oxidized to NO, and molecular nitrogen. Through this process the NOX is reduced by about 50%. The process is expensive to implement and reburn fuels are more expensive than coal. Additionally, many furnaces do not have sufficient volume to accommodate reburn.

The vertical or roof-fired design which is of primary concern to the present invention, involves the use of multiple burners. Each burner is subdivided into multiple individual fuel nozzles. The burners are located in the roof of the furnace and the fuel is fired vertically downward. Secondary air is introduced through roof openings which surround the fuel injection nozzles. Different furnaces will have different numbers of pulverizers, burners, and nozzles per burner.

The roof-fired design represents a relatively unique style of furnace that was designed and constructed in the late 1940's and early 1950's. The nitrogen oxide emissions from these units have not been extensively studied by applicants, but the emissions are believed to be above levels allowed by current or future regulations. Existing NOX reduction technology can not be easily applied to these roof-fired units. A retrofit using existing NOX reduction technology is expensive, costing approximately six to seven times the cost of a conventional wall-fired furnace retrofit. Consequently, there is a need for a combustion apparatus and method which will reduce nitrogen oxide emissions in flue gas and which can be readily used in existing roof-fired furnaces.

Kochey, U.S. Pat. No. 4,316,420, discloses the introduction of a greater portion of the combustion air flow at a location remote from where the fuel is initially burned.

Michelson, et al., U.S. Pat. No. 4,629,413, discloses blocking off secondary air openings near the fuel burner and reintroducing the secondary air at a remote location.

Hellewell, et al., U.S. Pat. No. 5,020,454, discloses the use of overfire air nozzles to inject overfire air at locations remote from the coal burner.

Yap, U.S. Pat. No. 5,229,929, issued, discloses the use of secondary air nozzles to achieve staged combustion.

SUMMARY OF THE INVENTION

The present invention provides an apparatus and method for reducing the formation of NOX during combustion in a roof-fired furnace. This is accomplished by a parallel flow air system where a portion of the combustion air is removed before it is introduced into the furnace and is introduced into the furnace roof at a location separated from the burners. The separated parallel flow overfire air ("SPFOFA") is taken from the secondary air duct and conducted to the top of the furnace at a location separate from the burners. From 10 to 40 percent of the air will be diverted, allowing initial combustion to occur in either a fuel-rich or a just slightly fuel-lean environment.

In many roof-fired furnaces the distance from the secondary air duct to the outside of the furnace roof is 5 feet or less. This short distance allows several SPFOFA ports to be installed with a minimum of expense.

Each air port can be fitted with a damper. Each port can be supplied with directional vanes which can divert the air into the combustion products or away from the combustion products as dictated by the performance results.

In the case of a nozzle-burner arrangement or other arrangement where the furnace roof is formed by boiler tubes with spaces between them, the SPFOFA can flow between the tubes. The SPFOFA ports may be partially blocked by the tubes, but no tubes will need to be cut out and replaced.

The system of SPFOFA flow can be used in roof-fired furnaces with the original burners whether they are the finger type burners or round register burners, and it can be used with replacement low NOX burners. The SPFOFA flow will reduce the oxygen available in the initial combustion zone and thereby reduce the NOX emissions. However, the air to fuel ratio in the primary flame zones will often be reduced to levels below the amount of oxygen needed to burn the fuel. The air entering through SPFOFA ports will mix with the hot, fuel-rich combustion products and substantially complete the combustion before the products exit the furnace.

In some cases the actual fuel to air ratio in the primary flame zone will continue to be fuel-lean. In this case the lowering of the excess air in this region will lower NOX emissions, SPFOFA flow will deprive the primary flames of some of the air needed for combustion. This, in conjunction with the slow mixing in the primary flame zone, especially the intentionally slow mixing caused by low NOX burners, will result in the volatile matter in coal being burned in an initially fuel-rich environment. Since only about 15% to 35% of fuel in coal is volatile matter, the flame where this is burned must contain less than 15% to 35% of the air required for substantially complete combustion, if the volatile matter is to burn in a fuel-rich environment. Since the deepest NOX reduction requires the volatiles, which contain much of the fuel bound nitrogen, to be burned in a fuel-rich environment, and less than half of the air will be introduced as SPFOFA, the burner itself must also retard and control mixing. These concerns equally apply to reducing the formation of thermal NOX.

SPFOFA extends the completion of flame to positions well down in roof-fired furnaces. The extended flame, in conjunction with prompt ignition of mixture of primary air and pulverized coal as it enters the furnace, results in initial combustion occurring under fuel-rich conditions.

Accordingly, it is an object of the present invention to provide a simple and inexpensive apparatus and method to alter existing roof-fired furnaces so that the amount of NOX formed during combustion is reduced. It is a further object of the present invention to provide an apparatus and method of reducing NOX emissions using separated parallel flow overfire air. It is yet another object of the present invention to create a fuel-rich environment for the initial combustion of pulverized coal.

These and other advantages and features are accomplished by the present invention which is more fully understood by reference to the drawings and the detailed description of the presently preferred embodiments thereof.

DETAILED DESCRIPTION OF THE PREFERRED EMBODIMENT

Figure 1A:
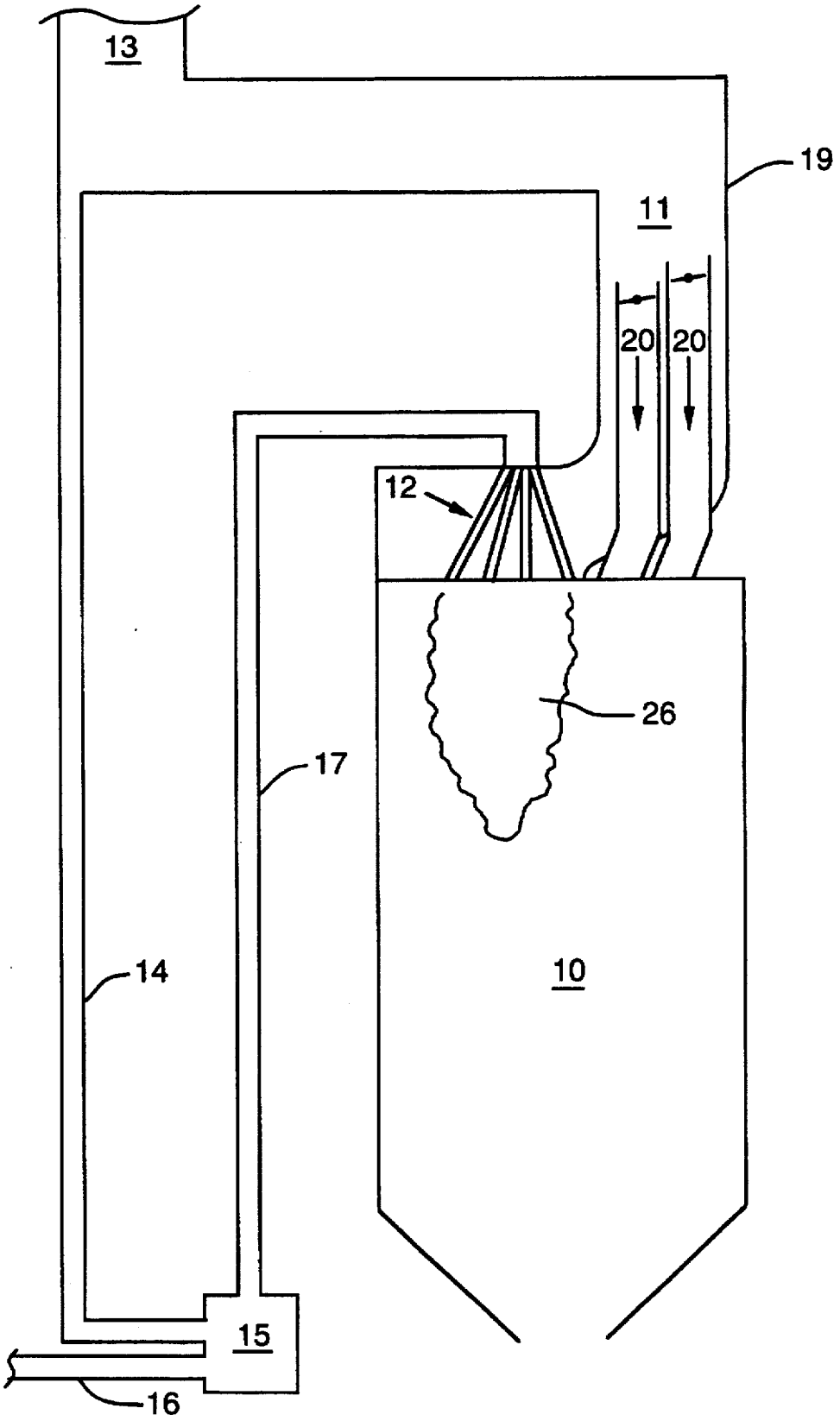
FIG. 1*a* is an overview of a furnace that is fired vertically from its roof.
Figure 1B:
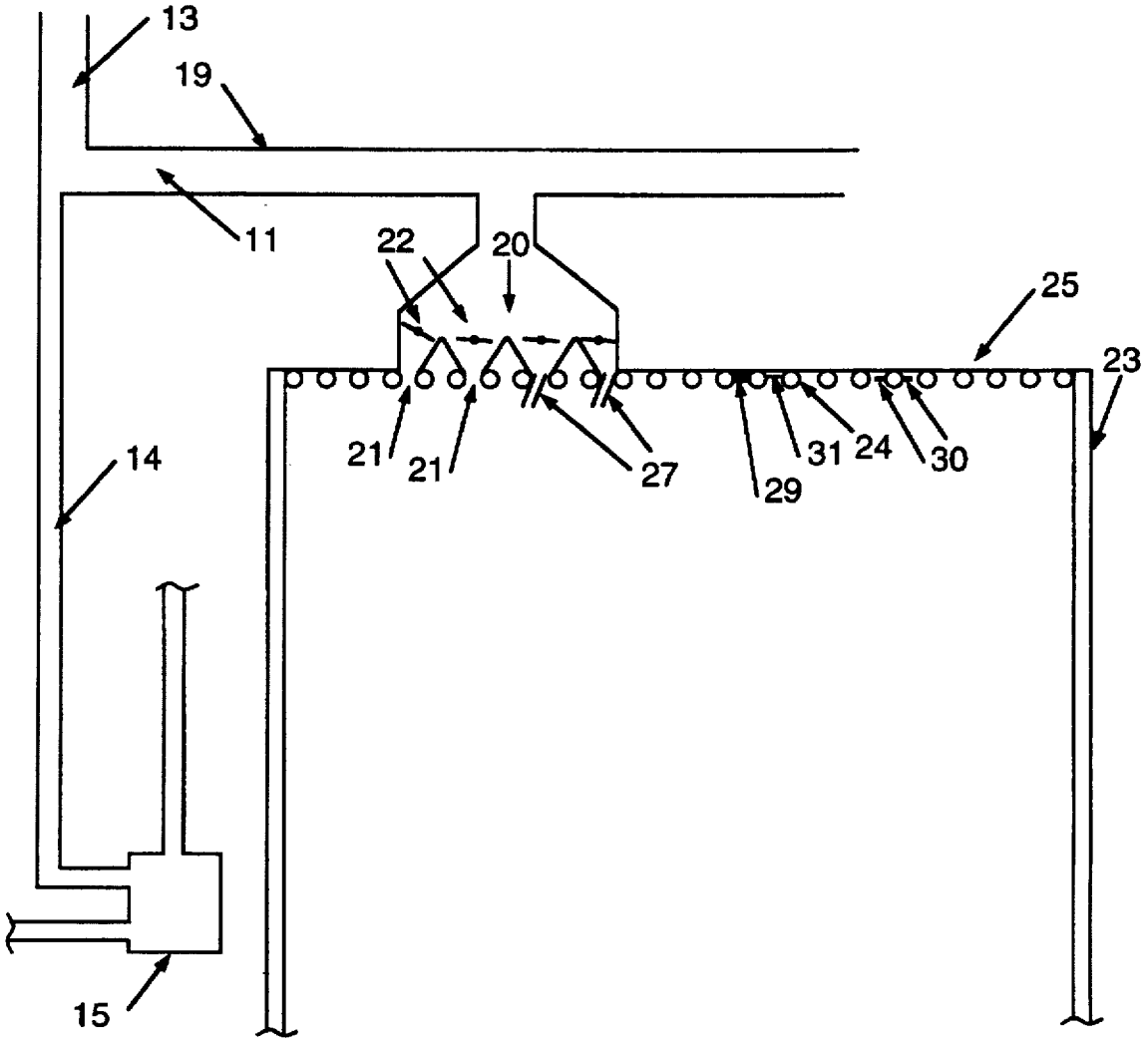
FIG. 1*b* is an overview of a furnace that is fired vertically from its roof. The system for distributing secondary air and the system for distributing pulverized coal and primary air are omitted for clarity.
Figure 2:
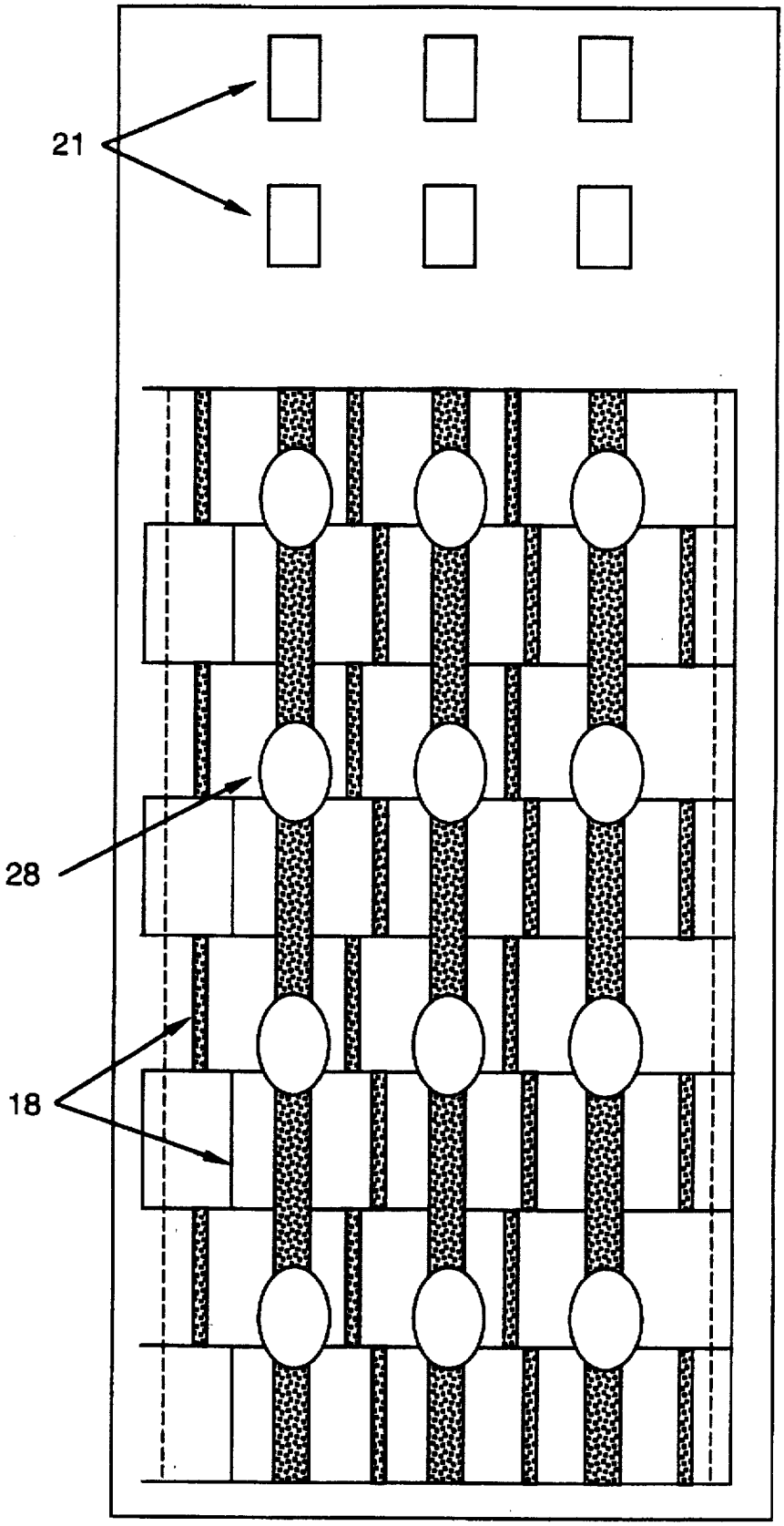
FIG. 2 shows a typical arrangement of diversion of secondary air to SPFOFA ports.

The present invention will be described in further detail by way of a preferred embodiment, particularly as shown in FIGS. 1*a*, 1*b*, and 2.

Referring to FIGS. 1*a*, 1*b*, and 2, an improved apparatus and method for reducing the formation of NOX in a conventional inter-tube roof-fired furnace 10 has been shown. Roof-fired furnace 10 is modified by re-directing some secondary air 11 so that it enters roof-fired furnace 10 at a location separate from roof burners 12.

Combustion air 13 is split into two streams: primary air 14 and secondary air 11. Primary air 14 goes to pulverizer 15 and mixes with pulverized coal 16. The resulting mixture of pulverized coal and air 17 flows to roof burners 12. From roof burners 12, mixture of pulverized coal and air 17 is burned in roof-fired furnace 10. Adjacent each roof burner 12 is a secondary air opening 18 that discharges secondary air 11 into roof-fired furnace 10. Secondary air 11 is transported to secondary air opening 18 via duct 19. Secondary air 11 mixes with combustion products 26 that are formed from the ignition of pulverized coal and air 17.

A portion of secondary air 11 is withdrawn from duct 19 and is introduced into roof-fired furnace 10 as separated parallel flow overfire air ("SPFOFA") 20. SPFOFA 20 is introduced into roof-fired furnace 10 through a plurality of SPFOFA ports 21 at a location separate from roof burners 12. Each SPFOFA port 21 is equipped with a damper 22 that allows for adjustment of the amount of SPFOFA 20 that flows through SPFOFA port 21. This withdrawal of SPFOFA 20 from secondary air 11 creates either a fuel-rich or just slightly fuel-lean environment adjacent roof burners 12. SPFOFA port 21 may be the terminus of a converging nozzle that directs SPFOFA 20 from duct 19 to SPFOFA port 21.

By introduction of SPFOFA 20 at a location separate from roof burner 12, NOX formation is reduced in two ways. First, fuel NOX formation is reduced by conducting the initial stages of combustion in a fuel-rich environment. Second, thermal NOX formation is reduced because the separate introduction of SPFOFA 20 lengthens the combustion zone in roof-fired furnace 10. This lengthened combustion zone can be more readily cooled by heat transfer to boiler tubes 23 that form the sides of roof-fired furnace 10 and boiler tubes 24 that form roof 25 of roof-fired furnace 10.

In one embodiment, a plurality of rows of SPFOFA ports 21 are located separate from each roof-burner 12. The plurality of SPFOFA ports 21 are positioned so that the rows are different distances from roof-burners 12. In this manner how quickly SPFOFA 20 mixes with combustion products 26 can be adjusted by dampers 22 to regulate how closely SPFOFA 20 is introduced to roof-burner 12. By varying how closely SPFOFA 20 is introduced to roof-burner 12, the length of time that initial combustion occurs in a fuel-rich or slightly fuel-lean environment can be controlled. In one embodiment, the amount of SPFOFA 20 that is introduced into roof-fired furnace 10 is about 15% to 40% of the total amount of combustion air 13. In one embodiment, SPFOFA ports 21 are equipped with vanes 27. Vanes 27 allow SPFOFA 20 to be directed either toward or away from roof-burner 12. In one embodiment roof-burner 12 uses a plurality of nozzles 28 to discharge mixture of pulverized coal and air 17 into roof-fired furnace 10. In one embodiment, roof-burner 12 is a low NOX burner. In one embodiment, roof boiler tubes 24 have refractory material 29 in between adjacent boiler tubes 24. In this embodiment enough refractory material 29 is removed to allow SPFOFA 20 to enter roof-fired furnace 10 through SPFOFA ports 21. Steel membrane 31 may be present between adjacent boiler tubes 24 either in place of refractory material 29 or in addition to refractory material 29.

In one embodiment roof boiler tubes 24 are covered with studs 30. In this embodiment, studded roof boiler tubes in the area adjacent SPFOFA ports 21 are removed and replaced with roof boiler tubes that are not studded. In another embodiment, studs 30 are removed from roof boiler tubes 24.

In one embodiment SPFOFA ports 21 are located between roof-burner 12 and a rear wall of roof-fired furnace 10. In one embodiment SPFOFA ports 21 are located between roof-burner 12 and a division wall of roof-fired furnace 10. In one embodiment SPFOFA ports 21 are located between roof-burner 12 and a front wall of roof-fired furnace 10. In one embodiment SPFOFA ports 21 are located between roof-burner 12 and both the front and rear walls of roof-fired furnace 10.

EXAMPLES

Examples 1 and 2 are given for a roof-fired furnace operated without the invention, so a comparison with these results can be used to determine how much improvement the invention makes. Examples 3, 4, 5, 6, 7, 8, 9, 10, and 11 illustrate the use of the invention. The Duquesne Light Company Elrama 1 furnace burning bituminous coal was used for all of the test examples.

Examples 1 and 2: Duquesne Light Company's Elrama 1, a roof-fired furnace, with two pulverizers, eight burners and 12 nozzles per burner. The furnace was operated at 91 megawatts ("MW") and no SPFOFA was used. The results were: NOX emissions were 0.72 pounds, as NO2 per million Btu ("MMBtu") and carbon monoxide ("CO") levels in the flue gas were 24 ppm. In a second baseline test, the furnace was operated to generate 96 MW with no SPFOFA and there results were: NOX emissions at 0.78 lb/MMBtu and CO at 23 ppm.

Example 3: Elrama 1 was equipped with two rows of SPFOFA ports which in total have the capacity to supply as much as 33% of the secondary air. The rear SPFOFA ports are more remote from the burners than the front SPFOFA ports. There are a total of 16 SPFOFA ports which allow air to flow down between boiler tubes that form the roof of the furnace. Each SPFOFA port has a damper. The air flows down through the roof, parallel to the primary air and coal and the secondary air. SPFOFA can be directed through the ports closest to the burners which causes it to mix sooner and better control burn out, carbon monoxide and carbon in the ash. Alternatively, SPFOFA can be directed through the ports furthest from the burners, which lowers NOX emissions. Or SPFOFA can be directed through both sets of burners. In this example, rear SPFOFA dampers were opened half-way (50%) and front SPFOFA dampers were closed (0%). This combination resulted in SPFOFA dampers being set at an aggregate 25% level. The unit was operated at 91 MW and the results were: NOX emission at 0.64 lb/MMBtu and CO at 16 ppm.

Examples 4 and 5: Elrama 1 modified as explained in Example 3, and was operated with the rear SPFOFA dampers fully open (100%) and the front SPFOFA ports at 0%. This combination resulted in the SPFOFA dampers being set at an aggregate 50% level. In Example 4 the unit was operated at 91 MW and the results were: NOX emissions at 0.55 lb/MMBtu and CO at 25 ppm. In Example 5, the unit was operated at 96 MW and the results were: NOX emissions at 0.62 lb/MMBtu and CO at 26 ppm.

Example 6, 7, and 8: Elrama 1 with the SPFOFA capability as explained in Example 3 was operated with the rear SPFOFA dampers at 100% and the front SPFOFA ports at 50%. This combination resulted in the SPFOFA dampers being set at an aggregate 75% level. In Example 6, the unit was operated at 96 MW and oxygen in the flue gas leaving the economizer was measured at 5.4%. The results were: NOX emissions at 0.35 lb/MMBtu and CO at 380 ppm. In Example 7, the unit was operated at 96 MW and oxygen in flue gas leaving the economizer was measured at 6.0%. The results were: NOX emissions at 0.40 lb/MMBtu and CO at 65 ppm. In Example 8, the unit was operated at 96 MW and the results were: NOX emissions at 0.44 lb/MMBtu and CO at 59 ppm.

Example 9: Elrama 1 with the SPFOFA capability as explained in Example 3 was operated with the rear SPFOFA dampers at 0% and the front SPFOFA dampers at 100%. This combination resulted in the SPFOFA dampers being set at an aggregate 50% level. The unit was operated at 96 MW and the results were: NOX emissions at 0.64 lb/MMBtu and CO at 23 ppm.

Example 10: Elrama 1 with the SPFOFA capability as explained in Example 3 was operated with the rear SPFOFA dampers at 50% and the front SPFOFA dampers at 50%. This combination resulted in the SPFOFA dampers at an aggregate 50% level. The unit was operated at 96 MW and the results were: NOX emissions at 0.55 lb/MMBtu and CO at 29 ppm.

Example 11: Elrama 1 with the SPFOFA capability as explained in Example 3 was operated with the rear SPFOFA dampers at 50% and the front SPFOFA dampers at 100%. This combination resulted in the SPFOFA dampers at an aggregate 75% level. The unit was operated at 96 MW and the results were: NOX emissions at 0.52 lb/MMBtu and CO at 32 ppm.

These examples show the improvement made by this unique overfire air system which provides SPFOFA adjacent burners in the roof of a roof-fired furnace. In some cases, NOX reductions of over 50% were achieved. The CO remained low in Example 6 although the 380 ppm may be higher than desired. This emission level of 0.35 lb/MMBtu is well below most expected limits for roof-fired furnace. Example 7 shows that the carbon monoxide can be decreased by increasing the air flow and yet the NOX, at 0.40 lb/MMBtu, was well below most widespread current limit of 0.50 lb/MMBtu. Example 11 showed unexpectedly good combustion efficiency as measured by the amount of unburned carbon in the flyash.

Figure 3:
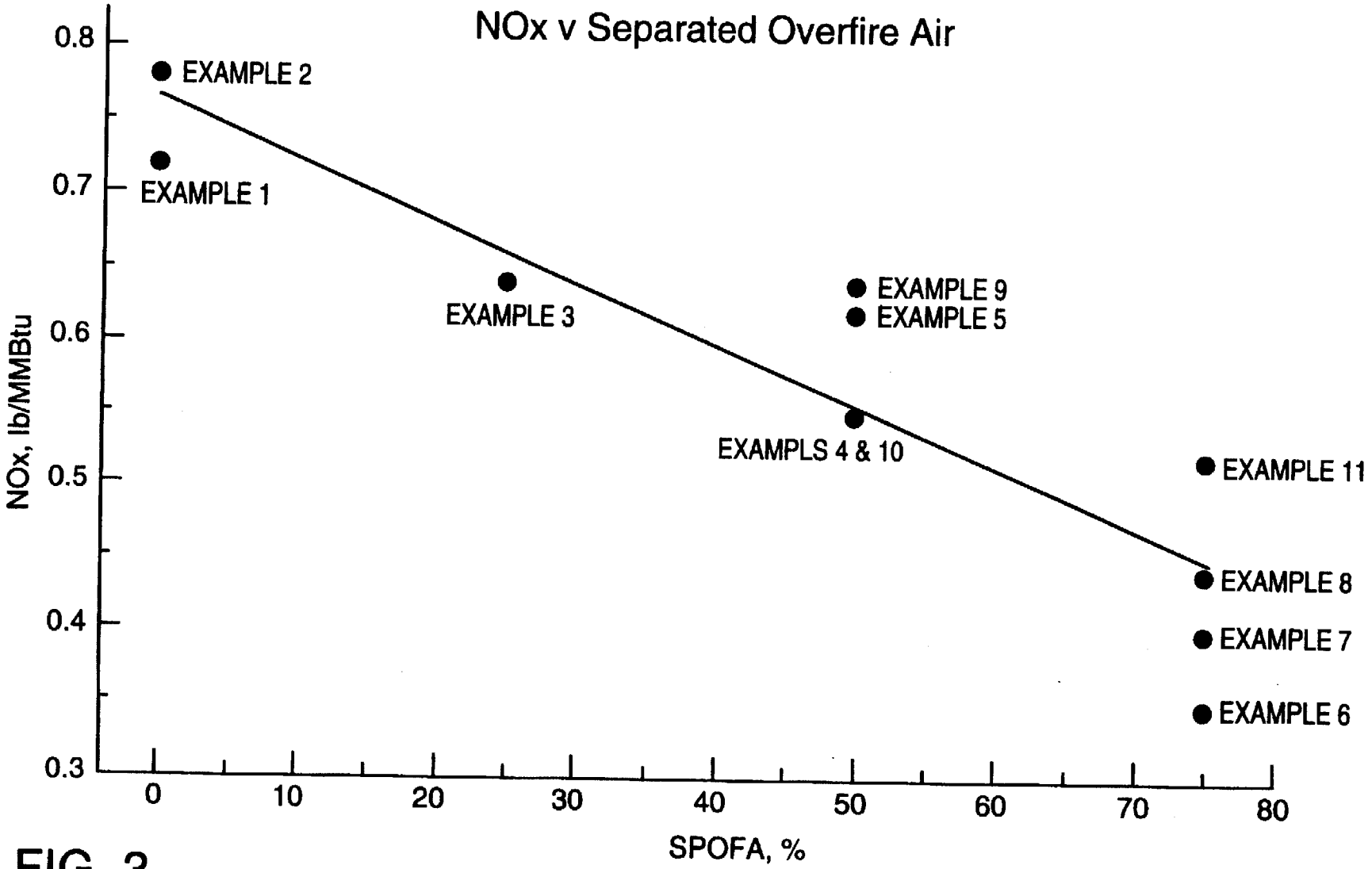
FIG. 3 shows the effect of SPFOFA damper position on NOX emissions.

FIG. 3 shows NOX emissions as a function of aggregate SPFOFA damper level. At a 75% level, the SPFOFA supplies about 24% of the secondary air needed to burn substantially the pulverized coal. Reductions in NOX emissions over the base-line tests were achieved with the SPFOFA dampers set at an aggregate 75% level.

While a present preferred embodiment of the invention is described, it is to be distinctly understood that the invention is not limited thereto but may be otherwise embodied and practiced within the scope of the following claims.

What is claimed is:

1. A method for reducing formation of nitrogen oxides during combustion in a roof-fired furnace comprising the steps of:

a) removing a portion of a secondary air flow from a duct;

b) transporting said removed portion of secondary air to a location of a roof of said roof-fired furnace separate from a location of coal burners; and c) introducing said removed portion of secondary air into said roof-fired furnace through separated parallel flow overfire ports made in said roof so that said removed portion of secondary air initially flows generally parallel to combustion products resulting from ignition of a mixture of pulverized coal and air discharged from said coal burners, wherein said removing step further comprises removing a sufficient amount of secondary air so that combustion adjacent said coal burners occurs in a fuel-rich environment.

2. The invention of claim 1, wherein said introducing step further comprises introducing about 15% to 40% of an amount of air needed to burn substantially said pulverized coal through said separated parallel flow overfire ports.

3. The invention of claim 1, wherein said introducing step further comprises introducing said removed portion of secondary air through two rows of said ports, one row of said ports being more remote from said burners than said other row of said ports.

4. The invention of claim 1, wherein said separated parallel flow overfire ports are partially blocked by boiler tubes of said roof of said furnace.

5. The invention of claim 1, wherein converging nozzles are used to guide the flow through the boiler tubes which partially block the roof of said furnace.

6. The invention of claim 1, further comprising the step of directing said removed portion of secondary air away from the flow of said combustion products.

7. The invention of claim 6, wherein said directing step further comprises directing said removed portion of secondary air away from the flow of said combustion products with fixed vanes.

8. The invention of claim 6, wherein said directing step further comprises directing said removed portion of secondary air away from the flow of said combustion products with movable vanes.

9. The invention of claim 1, further comprising the step of directing said removed portion of secondary air toward the flow of said combustion products.

10. The invention of claim 9, wherein said directing step further comprises directing said removed portion of secondary air toward the flow of said combustion products with fixed vanes.

11. The invention of claim 9, wherein said directing step further comprises directing said removed portion of secondary air toward the flow of said combustion products with movable vanes.

12. An apparatus for reducing emissions of nitrogen oxides from roof-fired furnaces comprising:

a) a plurality of separated parallel flow overfire air ports in a roof of said roof-fired furnace, b) coal burners in said roof, wherein said plurality of separated parallel overfire air ports are separated from said coal burners, and wherein said separated parallel flow overfire air ports discharge combustion air into said furnace in a direction that is generally parallel to a flow of mixture of pulverized coal and air from said coal burners, and c) fixed vanes for directing said flow of combustion air from said separated parallel flow overfire air ports towards said flow of mixture of pulverized coal and air.

13. The invention of claim 12 further comprising movable vanes for directing said flow of combustion air from said separated parallel flow overfire air ports towards said flow of mixture of pulverized coal and air.

14. The invention of claim 12 further comprising fixed vanes for directing said flow of combustion air from said separated parallel flow overfire air ports away from said flow of mixture of pulverized coal and air.

15. The invention of claim 12 further comprising movable vanes for directing said flow of combustion air from said separated parallel flow overfire air ports away from said flow of mixture of pulverized coal and air.

16. The invention of claim 12 wherein two rows of said separated parallel flow overfire ports are used, with one row of said ports more remote from said coal burners than said other row, and where a flow of said combustion air to each of said rows can be varied to change a distance from said coal burners at which most of said combustion air is discharged into said furnace.

17. The invention of claim 16, wherein each of said row of said ports are equipped with dampers that allow the flow of said combustion air through said row to be adjusted independently of the other said row.

18. The invention of claim 12 wherein said furnace is retrofitted with low NOX burners.

19. The invention of claim 12 wherein said separated parallel flow overfire air ports are designed to provide about 15% to 40% of said combustion air needed to burn said pulverized coal.

20. The invention of claim 12 wherein said roof of said furnace is formed by boiler tubes with spaces therebetween and wherein said spaces have at least a portion of a refractory material located therein removed to allow said flow of combustion air between said tubes.

21. The invention of claim 20 wherein said tubes have studs removed therefrom.

22. The invention of claim 20 wherein said tubes are replaced with non-studded tubes.

23. The invention of claim 12 wherein said roof of said furnace is formed by boiler tubes with spaces therebetween and wherein said spaces have at least a portion of a refractory material and a steel membrane located therein removed to allow said flow of combustion air between said tubes.

24. The invention of claim 23 wherein said tubes have studs removed therefrom.

25. The invention of claim 23 wherein said tubes are replaced with non-studded tubes.

26. The invention of claim 12 wherein said roof of said furnace is formed by boiler tubes with spaces therebetween and wherein said spaces have at least a portion of a steel membrane located therein removed to allow said flow of combustion air between said tubes.

27. The invention of claim 26 wherein said tubes have studs removed therefrom.

28. The invention of claim 26 wherein said tubes are replaced with non-studded tubes.

29. The invention of claim 12 wherein the secondary air flow to the burners is partially blocked.

* * * * *